United States Patent [19]

Schneider

[11] Patent Number: 4,966,348

[45] Date of Patent: Oct. 30, 1990

[54] METHOD AND APPARATUS FOR MONITORING ATMOSPHERE IN FURNACES

[75] Inventor: Harry E. Schneider, Elmwood Park, Ill.

[73] Assignee: Lindberg Corp., Chicago, Ill.

[21] Appl. No.: 374,441

[22] Filed: Jun. 30, 1989

[51] Int. Cl.[5] ..... C21D 11/00

[52] U.S. Cl. ..... 266/79; 266/99; 432/37; 148/16.5

[58] Field of Search ..... 266/79, 80, 81, 86, 266/89, 99, 173; 432/37, 113, 117; 148/16.5

[56] References Cited

U.S. PATENT DOCUMENTS

| | | | |
|---|---|---|---|
| 3,011,873 | 12/1961 | Davis | 266/80 |
| 3,058,815 | 10/1962 | Davis | 266/80 |
| 3,177,563 | 4/1965 | Pennell | 148/16.5 |
| 3,259,527 | 7/1966 | Beggs | 266/251 |
| 3,598,381 | 8/1971 | Schwalm et al. | 148/16.5 |
| 3,606,285 | 9/1971 | Bayer | 266/251 |
| 3,662,996 | 5/1972 | Schwalm et al. | 148/16.5 |
| 3,843,419 | 10/1974 | Schmidt et al. | 148/16.5 |
| 3,913,988 | 10/1975 | Scales et al. | 308/8.2 |
| 4,012,709 | 3/1977 | Logothetis et al. | 338/34 |
| 4,093,195 | 6/1978 | Schwalm | 266/251 |
| 4,162,889 | 7/1979 | Shigemura | 431/76 |
| 4,166,610 | 9/1979 | Yamazaki et al. | 266/89 |
| 4,183,213 | 1/1980 | Rao | 60/517 |
| 4,198,279 | 4/1980 | Brown et al. | 204/195 S |
| 4,230,651 | 10/1980 | Rao | 264/29.7 |
| 4,284,487 | 8/1981 | Barnes et al. | 204/195 S |
| 4,290,586 | 9/1981 | Kane et al. | 266/80 |
| 4,313,799 | 2/1982 | Perkins | 204/1 T |
| 4,351,182 | 9/1982 | Schmidberger | 73/27 R |
| 4,362,580 | 12/1982 | Kane et al. | 148/16.5 |
| 4,436,289 | 3/1984 | Connelly et al. | 266/80 |
| 4,588,493 | 5/1986 | Blumenthal et al. | 204/410 |
| 4,591,132 | 5/1986 | Wunning | 266/80 |
| 4,597,807 | 7/1986 | Fenstermaker et al. | 148/16.5 |
| 4,606,807 | 8/1986 | Mendenhall | 204/433 |
| 4,754,952 | 7/1988 | Hattori et al. | 266/80 |
| 4,763,880 | 8/1988 | Smith et al. | 266/87 |

*Primary Examiner*—S. Kastler

*Attorney, Agent, or Firm*—Fuller, Ryan & Hohenfeldt

[57] ABSTRACT

A method and apparatus for operating a rotary retort heat treating furnace involves incorporating an outlet for withdrawing furnace atmosphere from the retort above the axis of rotation and conveying the withdrawn gas remotely form measurement at the temperature conditions where the heat treatment process occurs. The method and apparatus also involves introducing the treatment atmosphere and sampling the atmosphere at a point adjacent the retort product discharge outlet. The use of the above-center outlet and remote probe eliminate structural problems encountered in prior art attempts to measure and control the furnace atmosphere in rotary retort furnaces.

26 Claims, 1 Drawing Sheet

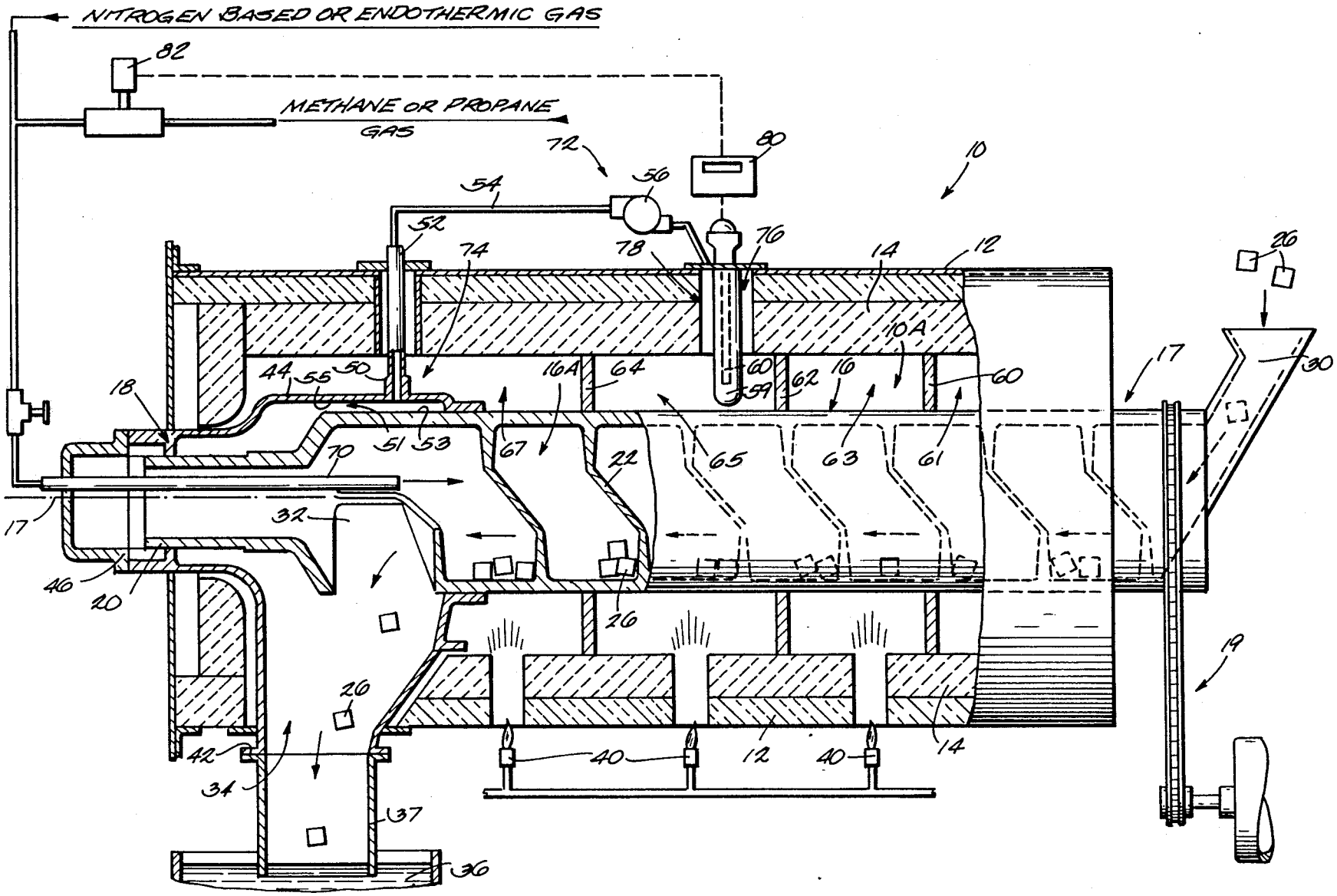
NITROGEN BASED OR ENDOTHERMIC GAS
METHANE OR PROPANE GAS

METHOD AND APPARATUS FOR MONITORING ATMOSPHERE IN FURNACES

FIELD OF INVENTION

The invention relates to rotary retort heat treating furnaces and, in particular, to the monitoring and control of atmospheres within these furnaces.

BACKGROUND OF THE INVENTION

Rotary retort furnaces are suited for heat treating relatively small parts, either by carburizing or neutral hardening techniques.

In this arrangement, the parts to be heat treated are fed into the interior of a rotating retort horizontally mounted in a furnace. The retort typically has helical flights formed along its inner walls. Rotation of the retort results in the movement of the parts progressively through the interior of the retort. The furnace is directly heated, and the parts are indirectly heated as they are conveyed through the rotating retort. During the progressive movement through the retort the parts are subjected to a desired heat treating atmosphere. The discharge end of the retort has an opening, where the parts fall through a discharge chute into an oil quench bath. The oil quench bath may have a conveyor to a move the parts to a washer and a tempering furnace in a continuous sequence.

Various furnace atmospheres are employed for heat treating. These are described in Metals Handbook, Ninth Edition, Volume 4, pages 393–399. The endothermic gas or gas atmosphere employed for heat treating is introduced at a pressure to provide a positive pressure in the retort to keep the room atmosphere out of the retort.

There is a predetermined temperature, or a predetermined range of temperatures, where the desired heat treating reaction occurs between the parts and the treatment atmosphere. Zone walls located within the furnace along the length of the retort create different temperature conditions within the retort to assure that, before the parts arrive at the discharge chute, their temperature has been properly elevated to the desired level. The furnace walls thereby create, by indirect heating, a discrete operative zone within the retort, located between its inlet and discharge ends, where the proper temperature conditions exist for the desired heat treatment process. On the inlet, side of this operative zone, the parts are indirectly preheated by the furnace. On the discharge side of this operative zone, the parts (now heat treated) lose heat as they enter the oil quench bath.

The discharge end of the retort is usually enclosed by a hood. The hood prevents the outside air from leaking into the discharge end of the retort. The hood is provided with an opening below the centerline of the retort to enable the parts to fall by gravity from the discharge end of the retort into the quench bath. The discharge chute is immersed in the quench bath to provide a liquid seal so that no room atmosphere will enter the retort through the discharge chute.

In retort, furnaces of this design, it is desirable to measure the heat treating atmosphere in the operative zone where the temperatures that are critical to the heat treatment process occur. However, prior attempts to accomplish this desireable objective have been unsuccessful. This is because the operative region of the retort is by necessity closed. Furthermore, the retort by necessity rotates within the furnace. Because of the structural configuration of rotary retort furnaces, there are few convenient places to insert a probe, except at its inlet or discharge ends.

In prior art attempts to monitor gas in rotating retorts, probes were mounted in a horizontal plane through the discharge end of the retort, where the parts fall into the quench bath. The horizontal mounting of the probe has been unsuccessful, because the probes did not have adequate structural integrity in a horizontal position to have a long useful life. Furthermore, these horizontal probes did not provide accurate results, because the oil vapors from the oil quench system adversely altered the probe measurements. In addition, since the treatment atmosphere is customarily introduced at the input end of the retort, by the time the atmosphere reaches the probe at the discharge end the retort, the sample can be influenced by contaminants introduced at the inlet of the retort, as well as introduced by the parts themselves as they are processed.

These probes did not provide accurate results for yet another reason. Being in the discharge end of the retort, the measurements of the probe were taken at temperatures different than the temperature critical for the treatment process, which occurs only in the operative zone.

Because of these problems, carbon control systems have not been commonly used in rotary retort furnaces. As a result, the heat treatment atmospheres have been inadequately monitored and controlled. Problems have occurred in the retort, including: sooting and plugging of the retort; contamination of parts and the quench bath; sticking of parts in the retort which causes mixing of parts of different sizes from one batch into another; clogging of carbon sensors; and reducing the life of the expensive alloy retort and hood casting components.

SUMMARY OF THE INVENTION

The invention provides method and apparatus for effectively monitoring and controlling the treatment atmosphere in a rotary retort.

In one aspect, the invention provides a heat treating retort comprising a furnace housing having an interior area and a retort supported for rotation within the interior area of the furnace housing. The retort includes an interior chamber having an inlet region for receiving the material to be heat treated, an outlet region for discharging the material after heat treatment, and a mechanism for advancing the material from the inlet region to the outlet region during rotation of the retort. A mechanism is provided for introducing a treatment atmosphere into the retort interior.

The interior area of the furnace is heated to indirectly heat the retort interior and establish between the inlet and outlet regions of the retort an operative region where predetermined temperature conditions exist to cause the desired reaction between the material and the treatment atmosphere within the retort.

A mechanism for analyzing the treatment atmosphere present within the retort is provided. This mechanism includes sampling means communicating with the retort chamber for withdrawing samples of the treatment atmosphere, and probe means communicating with the sampling means for analyzing the sampled atmosphere. The mechanism further includes vessel means that projects into the interior furnace area in the operative temperature region. The vessel means supports the probe means outside the retort for indirect heating at the desired temperature conditions. Therefore, the atmosphere sampled within the rotating retort is analyzed outside the retort at the temperature conditions where the heat treating process occurs. Accurate results are thereby obtained.

In a preferred embodiment, the treatment atmosphere is introduced into the outlet region of the retort interior, and the sampling means communicates with in the outlet region of the retort above the axis of rotation of the retort. This arrangement further enhances the accuracy of the measurements made by the probe, as the treatment atmosphere, virtually free of contamination, is naturally conveyed toward the sampling means.

Another aspect of the invention involves modifying the hood casting of a retort to provide a gas fitting for connection to an outlet conduit which taps the retort atmosphere in a zone of close clearance between the rotating retort and the hood casting.

In a preferred arrangement, the zone of close clearance is located above the rotational axis of the retort. This minimizes soot collection and exposure to the fumes of the quench discharge chute, as the retort serves as a buffer between the quench discharge chute and the gas sampling fitting.

In another aspect, the invention proves a method and associated apparatus for controlling the atmosphere in a rotary retort. The method and apparatus withdraw gas from the interior of the retort from a position above the centerline of the retort, and remotely enclose a probe in a vessel that is located outside of but in close proximity to the retort to indirectly expose the probe to the same temperatures that are present in the retort. In accordance with this aspect of the invention, the gas is conveyed to the remote probe for analysis at generally the same temperatures that are present in the retort.

In a preferred embodiment, the method and apparatus further use the measurements obtained by the probe to control the treatment atmosphere within the retort.

Further objects, advantages and features of the invention will be apparent from the disclosure.

DESCRIPTION OF THE DRAWINGS

The Figure is a schematic side elevational view in fragmentary section of a retort embodying the invention.

DESCRIPTION OF THE PREFERRED EMBODIMENT

Although the following disclosure is detailed and exact to enable those skilled in the art to practice the invention, the physical embodiments disclosed merely exemplify the invention, which may be embodied in other specific structure. The scope of the invention is defined in the appended claims.

The drawing shows a furnace 10 which is provided with a stationary metal outer wall 12 which can be lined with refractory bricks 14. A retort 16 having an interior chamber 16A is rotatably supported within the interior area of the furnace.

The retort 16 is rotatably supported at its drive end 17 by conventional supports (not shown) and rotatably supported by bearings and seals 18 at its opposite end 20. The retort 16 is driven continuously by a motor drive assembly 19.

The retort chamber 16A is provided with formed-in-place flights 22, which are arranged in a helical pattern to progressively convey the parts 26 to be treated from right to left. The parts are introduced into the retort interior 16A by an intake chute 30 and are discharged from a discharge chute portion 34 of the retort 16, which extends from a retort outlet 32.

The chute 34 empties the parts into an oil quench bath 36. A conduit 37 extends into the oil bath 36 to provide a seal to prevent room atmosphere from entering the retort 16 and contaminating the heat treating atmosphere.

A hood casting 44 carries the seals and bearings 18 for supporting the discharge end 32 of the, retort 16. The hood casting 44 is also provided with sealing surfaces 46 to seal the retort interior 16A from the outside atmosphere. The casting 44 is connected below the rotational axis 17 of the retort 16 to the conduit 37 at the flanged joint 42 by suitable fasteners. Parts exiting the retort outlet 32 fall by gravity through the chute 34 and into the quench bath 36.

Suitable burners 40 are provided to heat the interior area 10A of the furnace 10. The burners 40 indirectly heat the retort interior 16A. Alternatively, the interior area 10A can be heated by electric elements.

The furnace interior 10A surrounding the retort 16 is compartmentalized by walls 60, 62 and 64 into four different regions 61, 63, 65, and 67. In the first two regions 61/63, the burners 40 establish, by indirect heating, the temperature conditions needed to initially preheat the parts 26 as they advance through the retort chamber 16A from the inlet chute 30. In the third region 65, the burners 40 establish, by indirect heating, the predetermined temperature conditions for the desired heat treatment process. In the fourth region 67, surrounding the discharge outlet 32 of the retort, the parts 26 (now heat treated) begin to cool as they are dumped into the oil quench bath 36.

It should be appreciated that the furnace interior 10A may be compartmentalized differently and have more or less than the four compartments shown. The type of compartmentalization used will of course depend upon the operating characteristics desired.

By virtue of the compartmentalization shown in the illustrated embodiment, the third region 65 is the critical operative region of the furnace interior 10A, as it here that the temperature conditions necessary for the heat treatment process must be maintained.

A treatment atmosphere inlet pipe 70 extends into the retort chamber 16A adjacent to the discharge opening 32. Alternately, the inlet pipe 70 can be located adjacent to the inlet chute 30. However, the illustrated location adjacent to the discharge opening 32 is preferred, as it serves to optimize the features of the invention. In the illustrated arrangement, the inlet pipe 70 preferable extends within the retort 16 beyond the discharge chute 32.

The treatment atmosphere can vary. It may consist of either endothermic gas (in the case of neutral hardening (processes) or endothermic gas carrying natural gas (methane or propane) (in the case of a carburizing process). The treatment atmosphere can consist of any nitrogen-based atmosphere.

In the illustrated arrangement, the treatment gas is exhausted to atmosphere through the inlet chute 30 after passing through the retort chamber 16A, which in the process fills the chamber 16A with the treatment atmosphere. A positive internal gas pressure keeps room atmosphere from entering the retort chamber 16A through the chute 30.

In the illustrated embodiment, the flow of treatment gas is directed opposite to the advancement of the parts 26 through the retort chamber 16A. This arrangement, too, is preferred (but not mandatory), as it optimizes the benefits of the invention.

When exposed to the predetermined temperature conditions created in the operative region 65, a reaction occurs within the associated region of the retort chamber 16A between the surface of the parts 26 and the treatment atmosphere. This reaction constitutes the desire heat treatment process.

As it is desirable to control the heat treatment process, the invention provides means 72 for analyzing the treatment atmosphere within the retort chamber 16A. The analyzing means 72 includes sampling means 74 communicating with the retort chamber 16A for withdrawing samples of the treatment atmosphere, and probe means 76 communicating with the sampling means 74 for analyzing the sampled atmosphere. The analyzing means 72 also includes vessel means 78 projecting into the interior furnace area 10A in the critical operating temperature region 65. The vessel means 78 supports the probe means 76 outside the retort chamber 16A for indirect heating at the predetermined temperature conditions, so that the atmosphere sampled within the retort chamber 16A is analyzed outside the retort chamber 16A at the predetermined temperature conditions.

The sampling means 74 can be variously located within the retort chamber 16A. In a preferred arrangement, the sampling means 74 communicates with the retort chamber 16A at a location that is above the rotational axis 17 of the retort 16. In the illustrated embodiment, the axis 17 is generally along the centerline of the retort 16.

Also, the sampling means 74 preferably communicates with the retort chamber 16A in the region where the inlet pipe 70 enters the retort 16. In the illustrated embodiment, this is at the discharge end 32 of the retort 16.

While the sampling means 74 can be variously constructed, in the illustrated and preferred embodiment, the sampling means 74 is located in the hood casting 44. More particularly, the hood casting 44 creates an open zone 51 that communicates with the retort chamber 16A above the rotational axis 17 of the retort 16. The zone 51 is formed between the surface 53 of the retort 16 and the surface 55 of the hood casting 44. Treatment atmosphere from the retort chamber 16A exits through the product outlet 32 as outlet 32 rotates past the zone 51.

A fitting 50 is located in the hood casting 44. The fitting 50 communicates with the open zone 51. The fitting 50 is connected to a conduit 52, which, in turn, communicates with a conduit 54 and a pump 56. The treatment atmosphere that enters the zone 51 from the retort interior 16A is withdrawn through this arrangement for sampling.

The pump 56 delivers the atmosphere to be sampled to the vessel means 78, which in the illustrated embodiment is a closed container or vessel 59 which encloses the probe means 76.

The probe means 76 can be variously constructed. In the illustrated embodiment, the probe means 76 constitutes an oxygen probe 60 made in accordance with FIG. 4 of U.S. Pat. No. 4,588,493, the entire disclosure of which is incorporated by reference. This probe 60 has ceramic surfaces which reduce catalytic action which can cause sooting of the probe. This probe 60 is available from Furnace Control Corporation in Brookfield, Wis.

The vessel 59 is inserted within the critical third zone 65 of the furnace interior 10A, outside of but in close proximity to the retort 16. The vessel 59, like the retort 16, is thereby indirectly exposed to the same preferred temperature conditions existing in the zone 65 required for the desired heat treatment process. This is because the source of heat for the retort interior 16A (i.e., burners 40) is the same source of heat for the vessel 59. An extremely accurate measurement of the gas sample can thereby be made at the precise operating temperature conditions at which the heat treatment process is occurring.

Furthermore, the juxtaposition of the sampling means 74 and the gas inlet 70 assure a relatively contamination-free sample. As the sampling means 74 is located above the rotational axis 17 of the retort 16, the treatment gas that is introduced in an adjacent region of the retort 16 naturally rises toward the sampling means 74. The counterflow of the treatment atmosphere, opposite to the advancement of parts 26 through the retort 16, also serves to reduce the chance of contamination from gases from the inlet end 30 of the retort 16.

The juxtaposition of the retort 16 between the discharge chute 32 and the fitting 50 also serves as a buffer, keeping contaminating vapors of the quench bath 36 away from the sampling means.

The electrical signals generated by the probe 60 in FIG. 1 are conveniently supplied to a probe control box 80 which also controls the valves 82 which regulate the flow of gas as required for the particular heat treating parameters required.

I claim:

1. A heat treating retort comprising a furnace housing having an interior area, a retort supported for rotation within the interior area of the furnace housing, the retort including an interior chamber having an inlet region for receiving the material to be heat treated, an outlet region for discharging the material after heat treatment, and means for advancing the material from the inlet region to the outlet region during rotation of the retort, means for introducing a treatment atmosphere into the retort chamber, means for directly heating the interior area of the furnace to indirectly heat the retort chamber and establish an operative temperature region between the inlet and outlet regions of the retort chamber where predetermined temperature conditions exists to cause the desired reaction between the material and the treatment atmosphere to occur within the retort chamber, and means for analyzing the treatment atmosphere present within the retort chamber including sampling means communicating with the retort chamber for withdrawing samples of the treatment atmosphere, probe means communicating with the sampling means for analyzing the sampled atmosphere, and vessel means projecting into the interior furnace area in the operating temperature region and supporting the probe means outside the retort chamber for indirect heating at the predetermined temperature conditions so that the atmosphere sampled within the retort chamber is analyzed outside the retort chamber at the predetermined temperature conditions.

2. A heat treating retort according to claim 1 wherein the sampling means communicates with the retort chamber at a position above the axis of rotation of the retort.

3. A heat treating retort according to claim 1 wherein the means for introducing a treatment atmosphere into the retort chamber is located in the outlet region of the retort, and wherein the sampling means communicates with the outlet region of the retort.

4. A heat treating retort according to claim 3 wherein the sampling means communicates with the outlet region above the axis of rotation of the retort.

5. A heat treating retort according to claim 1 wherein the sampling means communicates with the retort chamber in a region where the means for introducing a treatment atmosphere into the retort chamber is located.

6. A heat treating retort according to claim 1 wherein the means for introducing a treatment atmosphere into the retort chamber is located in the outlet region of the retort and is operative for directing the treatment atmosphere in a counterflow pattern opposite to the advance of material within the retort chamber.

7. A heat treating retort according to claim 6 wherein the sampling means communicates with the outlet region of the retort above the axis of rotation of the retort.

8. A heat treating retort according to claim 1 and further including a discharge chute located below the rotational axis of the retort for receiving heat treated materials exiting the outlet region of the retort, and wherein the sampling means communicates with the outlet region of the retort at a location above the rotational axis of the retort.

9. A heat treating retort according to claim 8 wherein the means for introducing a treatment atmosphere into the retort chamber is located in the outlet region of the retort between the sampling means and the discharge chute.

10. A heat treating rotary retort comprising a retort having an interior for confining a treatment atmosphere and an opening communicating with the interior, a furnace housing enclosing the retort and including enclosure support means for rotatably supporting the retort within the housing and sealing the interior of the retort from the atmosphere outside the furnace housing, the support means includes wall means located about the opening of the retort for forming a stationary zone within the furnace housing for receiving atmosphere that exits the interior of the rotating retort through the opening, and gas withdrawal means in the walls means for withdrawing atmosphere present in the stationary zone for sampling.

11. A heat treating retort according to claim 10 wherein the opening of the retort includes a heat treated product discharge opening, wherein the wall means comprises a stationary hood adjacent to the discharge opening of the retort, and wherein the gas withdrawal means comprises an outlet fitting in the hood, the outlet fitting being attached to a conduit and pump assembly for withdrawing from the stationary zone a sample of atmosphere out of the discharge opening of the retort.

12. A heat treating retort according to claim 11 and further including gas inlet means connected to the retort for introducing treatment atmosphere into the retort at a point adjacent the discharge opening of the retort.

13. A heat treating retort according to claim 10 and further including a sensor probe communicating with the gas withdrawal means and a vessel provided in the outer wall of the furnace housing for enclosing the sensor probe outside of the retort, the vessel extending close to the retort to maintain the enclosed sensor probe at a temperature proximate the temperature of the treatment atmosphere at that position within in the retort.

14. A heat treating retort according to claim 10 wherein the open zone is located above the axis of rotation of the retort.

15. A rotary retort comprising a furnace housing, a retort supported for rotation within the furnace housing, means for withdrawing gas from the interior of the retort from a position above the centerline of the retort, means for remotely enclosing a probe in a vessel within the furnace housing outside of but in close proximity to the retort to indirectly expose the probe to the same temperatures that are present in the adjacent region of the retort, and means for conveying the gas to the remote probe for analysis.

16. A rotary retort according to claim 15 and further including means for introducing the treatment gas into the retort in the region where the means for withdrawing gas is located.

17. A rotary retort according to claim 16 and further including means for using the measurements obtained by the probe to control the atmosphere within the retort.

18. A method of controlling the atmosphere in a rotary retort comprising the steps of exposing the exterior of the retort to a source of heat to heat the interior of the retort to desired temperatures, withdrawing gas from the interior of the retort from a position above the centerline of the retort, enclosing a probe in a vessel that is located outside of but in close proximity to the retort to expose the vessel to the same source of heat as the retort and heat the probe to the temperatures that are present in the adjacent interior region of the retort, and conveying the gas to the probe for analysis at generally the same temperatures that are present in the retort.

19. A method according to claim 18 and further including the step of introducing the treatment gas into the retort in the region where the gas sample is withdrawn.

20. A method according to claim 19 and further including the step of using the measurements obtained by the probe to control the atmosphere within the retort.

21. A heat treating retort comprising a retort having an interior chamber with an inlet region for receiving the material to be heat treated and an outlet region for discharging the material after heat treatment, and including means for advancing the material from the inlet region to the outlet region during rotation of the retort, a furnace housing having an interior area and including means for supporting the retort for rotation within the interior area of the furnace housing and for sealing the retort chamber from communication with the outside atmosphere, means for introducing a treatment atmosphere into the retort chamber, means for directly heating the interior area of the furnace to indirectly heat the retort chamber and establish an operative temperature region between the inlet and outlet regions of the retort chamber where predetermined temperature conditions exists to cause the desired reaction between the material and the treatment atmosphere to occur within the retort chamber, and means for analyzing the treatment atmosphere present within the retort chamber including means for forming an opening in the retort, wall means adjacent to the retort opening for forming a stationary zone within the furnace housing that extends between the wall means and the retort opening and that receives treatment atmosphere exiting from the interior retort chamber through the opening, sampling means communicating with the stationary zone for withdrawing a sample of the treatment atmosphere, probe means communicating with the sampling means for analyzing the sampled atmosphere, and vessel means projecting into the interior furnace area in the operating temperature region for supporting the probe means outside the retort chamber for indirect heating to the predetermined temperature conditions so that the treatment atmosphere obtained from the stationary zone is analyzed at the predetermined temperature conditions.

22. A heat treating retort according to claim 21 wherein the stationary zone extends, at least in part, above the axis of rotation of the retort, and wherein the sampling means communicated with the stationary zone at a position above the rotational axis of the retort.

23. A heat treating retort according to claim 21 wherein the retort opening is located in the outlet region of the retort.

24. A heat treating retort according to claim 23 wherein the stationary zone extends, at least in part, above the axis of rotation of the retort, and wherein the sampling means communicated with the stationary zone at a position above the rotational axis of the retort.

25. A heat treating retort according to claim 23 wherein the means for introducing the treatment atmosphere is located at a point adjacent the outlet region of the retort.

26. A heat treating retort according to claim 25 wherein the means for introducing the treatment atmosphere is operative for directing the treatment atmosphere in a counterflow pattern opposite to the advance of material within the retort chamber.

* * * * *